United States Patent [19]

Kondo

[11] Patent Number: 4,971,466

[45] Date of Patent: Nov. 20, 1990

[54] PRINTING APPARATUS HAVING A ROTATABLE MEMBER ROTATABLE IN INCREMENTAL STEPS SMALLER THAN THE PITCH OF A DETENT GEAR AND INCLUDING MEANS FOR ACCURATELY RETAINING THE ROTATABLE MEMBER AT A PREDETERMINED POSITION WHEN THE DETENT MECHANISM IS INOPERABLE

[75] Inventor: Hiroatsu Kondo, Zushi, Japan

[73] Assignee: Canon Kabushiki Kaisha, Tokyo, Japan

[21] Appl. No.: 368,882

[22] Filed: Jun. 20, 1989

Related U.S. Application Data

[63] Continuation of Ser. No. 193,164, May 6, 1988, abandoned, which is a continuation of Ser. No. 68,726, Jul. 1, 1987, abandoned, which is a continuation of Ser. No. 807,787, Dec. 12, 1985, abandoned, which is a continuation of Ser. No. 605,840, May 1, 1984, abandoned.

[30] Foreign Application Priority Data

May 24, 1983 [JP] Japan ..... 58-89981

[51] Int. Cl.[5] ..... B41J 19/82

[52] U.S. Cl. ..... 400/577; 400/568; 400/902; 400/575

[58] Field of Search ..... 400/555, 563, 564, 564.1, 400/565, 566, 566.1, 567, 568, 569, 571, 572, 577, 902, 904

[56] References Cited

U.S. PATENT DOCUMENTS

| | | | |
|---|---|---|---|
| 1,027,391 | 5/1912 | Raber | 400/577 |
| 1,229,521 | 6/1917 | Rhea | 400/566 |
| 2,831,559 | 8/1958 | Riffert . | |
| 3,272,303 | 10/1966 | Pohl . | |
| 3,618,738 | 11/1971 | Boyatt et al. | 400/565 X |
| 3,820,646 | 11/1974 | Lombardi . | |
| 3,880,016 | 4/1975 | Jamieson et al. | 74/405 |
| 3,902,584 | 9/1975 | Lee et al. | 400/902 |
| 3,915,281 | 10/1975 | Blomquist et al. . | |
| 3,935,938 | 2/1976 | Hodne | 400/569 X |
| 4,039,069 | 8/1977 | Kwan et al. | 400/902 X |
| 4,181,444 | 1/1980 | Heider | 400/555 |
| 4,195,940 | 4/1980 | Rekewitz | 400/568 |
| 4,368,413 | 1/1983 | Tazaki | 318/687 |
| 4,383,778 | 5/1983 | Costa | 400/569 |
| 4,407,003 | 9/1983 | Fukui | 400/120 X |
| 4,494,887 | 7/1985 | Wincent | 400/568 |

FOREIGN PATENT DOCUMENTS

| | | |
|---|---|---|
| 0038216 | 10/1981 | European Pat. Off. . |
| 2758148 | 5/1979 | Fed. Rep. of Germany . |
| 66005089 | 5/1981 | Fed. Rep. of Germany . |
| 3122985 | 12/1982 | Fed. Rep. of Germany . |
| 811015 | 3/1959 | United Kingdom . |
| 1280445 | 7/1972 | United Kingdom . |
| 1282558 | 7/1972 | United Kingdom . |
| 1489792 | 10/1977 | United Kingdom . |
| 2026949 | 2/1980 | United Kingdom . |
| 2139149A | 11/1984 | United Kingdom . |

OTHER PUBLICATIONS

IBM Technical Disclosure Bulletin, vol. 19, No. 8, Jan. 1977, pp. 2974–2975, "Stepping Motor Stop Control" by Barnett et al.

IBM Technical Bulletin, vol. 17, No. 4, "Electromechanical Variable-Index System", pp. 959–960, Sep. 1974.

*Primary Examiner*—David A. Wiecking

*Attorney, Agent, or Firm*—Fitzpatrick, Cella, Harper & Scinto

[57] ABSTRACT

There is described a printing apparatus in which line feed is achieved by rotating a platen with a paper advancing motor and the printing is conducted while the platen is stopped by the paper advancing motor. The printer is further provided with a detent mechanism for stopping the platen at the interval of a determined angle, and a solenoid for deactivating the function of the detent mechanism.

15 Claims, 3 Drawing Sheets

PRINTING APPARATUS HAVING A ROTATABLE MEMBER ROTATABLE IN INCREMENTAL STEPS SMALLER THAN THE PITCH OF A DETENT GEAR AND INCLUDING MEANS FOR ACCURATELY RETAINING THE ROTATABLE MEMBER AT A PREDETERMINED POSITION WHEN THE DETENT MECHANISM IS INOPERABLE

This application is a continuation of application Ser. No. 193,164, filed May 6, 1988, now abandoned, which is a continuation of Ser. No. 068,726, filed July 1, 1987, now abandoned, which is a continuation of Ser. No. 807,787, filed Dec. 12, 1985, now abandoned, which is a continuation of Ser. No. 605,840, filed May 1, 1984, now abandoned.

BACKGROUND OF THE INVENTION

1. Field of the Invention

The present invention relates to a printing apparatus, and more particularly to a printing apparatus in which a printing sheet is advanced by the rotation of a platen and the printing action is conducted while said platen is stopped.

2. Description of the Prior Art

In the conventional printers such as typewriters there is widely employed a structure in which the printing sheet is advanced by the rotation of a platen with a paper advancing motor, and said platen is locked still during the printing action.

FIGS. 1 and 2 illustrate an example of such conventional printing apparatus.

A printing sheet 2 is wound around a platen 1 and maintained thereon without slack with pressure rollers 3, 4. A paper advancing motor 5, composed of a stepping motor for ease of control and for lower cost, transmits rotative motion to the platen 1 through a pulley 6, a belt 7 and another pulley 8.

A detent gear 9, provided with triangular teeth along the outer periphery, is supported on a shaft for the platen 1 and the pulley 8. A detent lever 10 is rotatably supported by a shaft 11 and is biased by a spring 12 in such a manner that a front end 10*a* of said lever is pressed against a stable point 9*a* between triangular teeth.

FIG. 2 is a lateral view seen from a direction A shown in FIG. 1, wherein a peripheral length l of the platen corresponds to a length advanced by a step or several steps of the paper advancing motor 5. Upon energization of said motor 5, the rotating force is transmitted to the detent gear 9 through the pulley 6, belt 7 and pulley 8, but said detent gear rotates in a direction B only when the resulting torque exceeds the pressing force of the spring 12 with which the front end 10*a* is pressed between the triangular teeth of the detent gear 9. Upon said rotation the front end 10*a* is pushed away in a direction C and then engages with a neighboring stable point 9*b*. Then the energizing current to the paper advancing motor 5 is terminated, and the platen 1 thus stops the rotation and becomes locked.

As explained in the foregoing, the constant contact of the front end 10*a* of the detent lever 10 with the triangular teeth of the detent gear 9 in the conventional mechanism gives rise to noise and abrasion and requires a large torque in the paper advancing motor 5. Also in case the printing is to be made at a position different from the regular printing positions defined by the length l, the obtained prints become positionally unstable due to the presence of the above-described detent mechanism.

SUMMARY OF THE INVENTION

In consideration of the foregoing, the object of the present invention is to provide a printing apparatus which is free from noise and abrasion, only requires a smaller torque in the paper advancing motor and enables stable printing at a position different from the stepped positions on the platen.

BRIEF DESCRIPTION OF THE DRAWINGS

FIGS. 3 to 6 illustrate an embodiment of the present invention, wherein FIG. 3 is a perspective view showing the principal parts of an embodiment of the present invention;

FIG. 4 is a lateral view of said embodiment seen from a direction A shown in FIG. 3;

FIG. 5 is a timing chart showing signals in case of stopping the platen at a stable position of the detent mechanism; and FIG. 6 is a timing chart showing signals in case of stopping the platen at another position.

DETAILED DESCRIPTION OF THE PREFERRED EMBODIMENTS

Now the present invention will be clarified in detail by reference to an embodiment thereof shown in the attached drawings.

Figure 1:
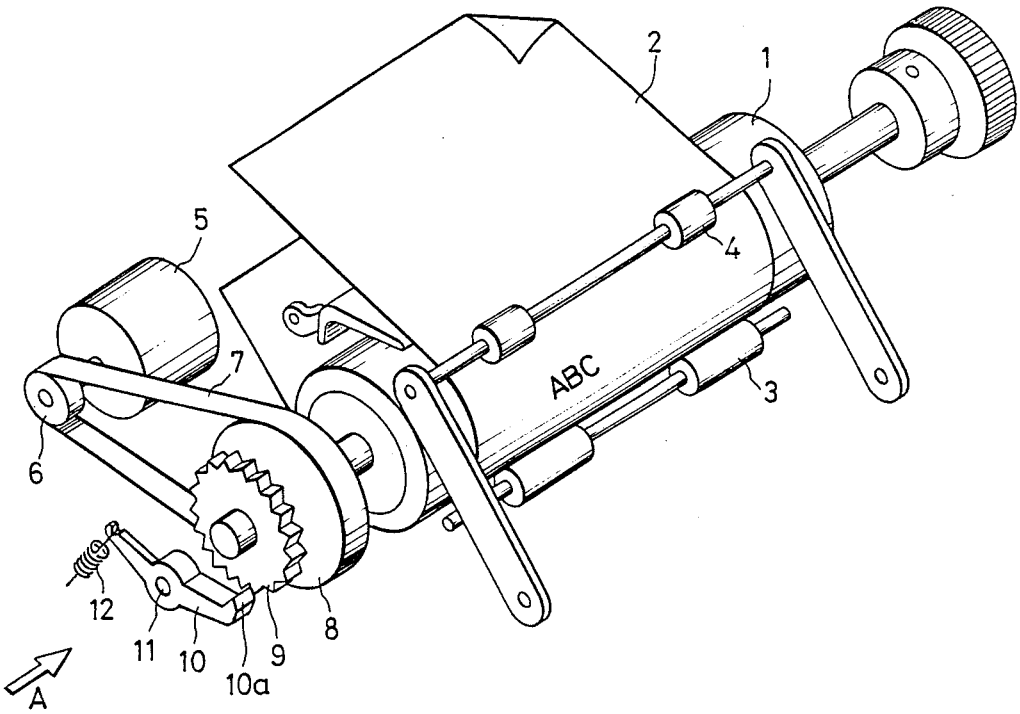
FIG. 1 PRIOR ART
FIG. 1 is a perspective view showing a conventional structure.
Figure 2:
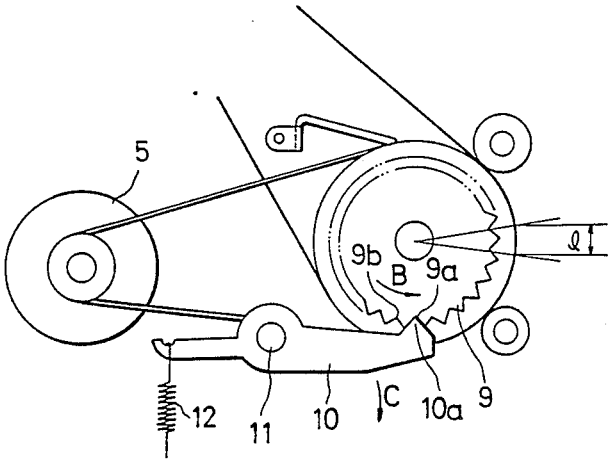
FIG. 2 PRIOR ART
FIG. 2 is a lateral view of said structure seen from a direction A shown in FIG. 1.
Figure 3:
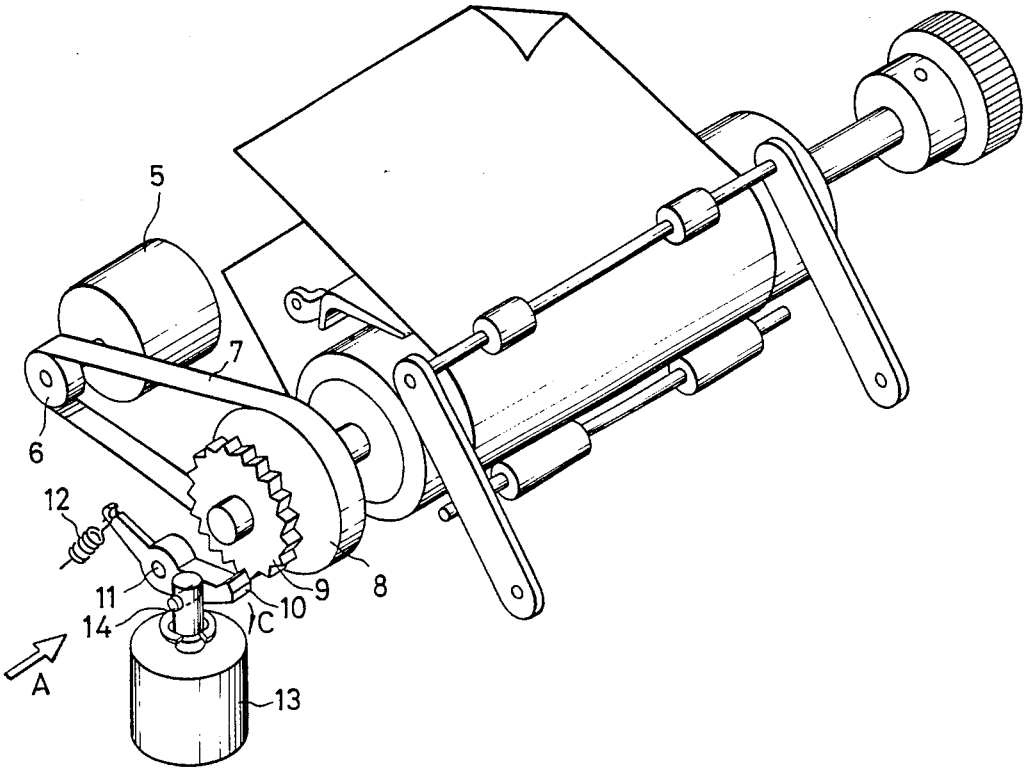
Figure 4:
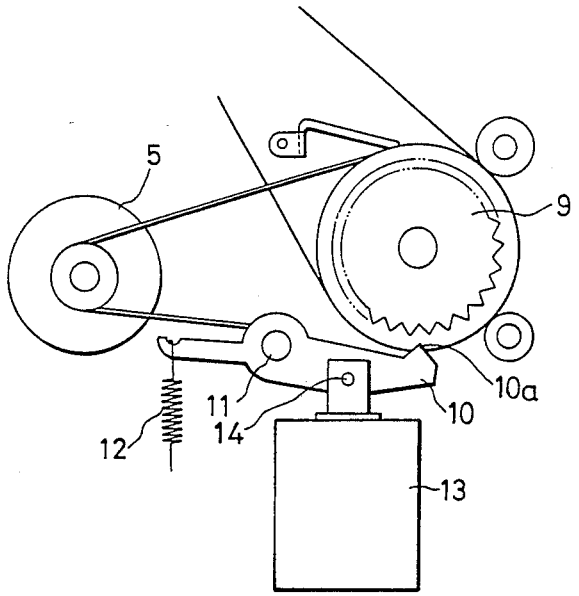

FIGS. 3 and 4 illustrate an embodiment of the present invention, wherein the same components as those already shown in FIGS. 1 and 2 are represented by the same numbers and are omitted from the following description.

In FIGS. 3 and 4, there is provided a solenoid 13, of which pin 14 engages with the detent lever 10 to rotate the same clockwise, as shown by an arrow C, about the shaft 11 against the pressure of the spring 12 when the solenoid 13 is energized, whereby the front end 10*a* of the detent lever 10 is disengaged from the triangular teeth to release the platen from the detent state.

When the motor 5 is stopped after rotating the platen by an angle determined by a signal, the energizing current to the solenoid 13 is terminated whereby the detent lever 10 is rotated anticlockwise by the spring 12 and engages with the detent gear 9.

Figure 5:
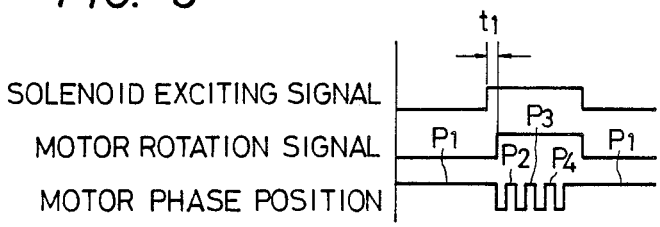

FIG. 5 is a timing chart showing the function in case of rotating the platen by a peripheral length l in four steps of the paper advancing motor 5. For rotating the platen, an energizing signal is supplied to the solenoid 13 earlier by a determined time $t_1$ than the start of a rotation signal to the motor 5 or of the motor energizing voltage.

Upon energization of the solenoid 13, the detent lever 10 is rotated clockwise about the shaft 11 by the pin 14 and against the force of the spring 12, whereby the front end 10*a* of the detent lever 10 is completely separated from the detent gear 9 as shown in FIG. 4, thus releasing the platen 1 from the detent state.

Simultaneously when the motor 5 is stopped after rotating the platen 1 by an angle determined by a signal, the energizing current to the solenoid 13 is terminated whereby the front end 10*a* of the detent lever 10 engages with the detent gear 9.

In case of graphic printing or the like for example, it often becomes necessary to select the minimum moving length smaller than the peripheral unit length l on the platen, for example a moving length of l/4. Such movement of length l/4 is rendered possible if the platen movement of l is achieved by four steps of the motor.

In order to stop the platen at a length of l/4, it becomes necessary to stop the motor at a phase other than P1 among the four phases P1, P2, P3 and P4 of the stepping motor. In such case, as shown in FIG. 6, the solenoid 13 is at first energized to release the detent lever 10 from the detent gear 9, then the paper advancing motor 5 is energized for a determined period $t_1^x$ to advance the platen 1 to a position corresponding to either of the phases P2, P3 or P4 of the paper advancing motor 5, and the motor energizing voltage is thereafter reduced to a retaining voltage $V_h$ to electromagnetically lock the platen during the printing action.

Figure 6:
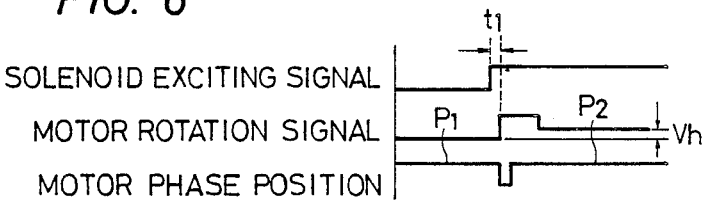

It will be understood that FIG. 6 shows a case in which the platen is stopped at a position corresponding to the phase P2.

As explained in the foregoing, the apparatus of the present invention, in which the front end of the detent lever is maintained completely separate from the detent gear during the rotation of the platen, avoids the noise and abrasion of the mechanism. Also the stopping position of the platen can be precisely selected to be smaller than the minimum stopping interval in the conventional detent mechanism.

What I claim is:

1. A printing apparatus for recording on a recording medium, comprising:

a rotatable member for feeding a recording medium;

a motor for driving said rotatable member;

drive transmission means for transmitting the drive force of said motor to said rotatable member to rotate said rotatable member;

detent means adapted to assume a restraint state in which rotation of said rotatable member is restrained and a release state in which said restraint state is released thereby permitting rotation of said rotatable member;

drive means for placing said detent means into the release state, in response to a predetermined signal;

control means for controlling said detent means and said motor to electrically lock said rotatable member by reducing the voltage applied to said motor to a retaining voltage after said rotatable member is rotated by a predetermined amount by applying a drive voltage to said motor while maintaining said detent means in the release state.

2. Printing apparatus according to claim 1, wherein said rotatable member is a platen.

3. Printing apparatus according to claim 1, wherein said motor is a stepping motor.

4. Printing apparatus according to claim 1, wherein said control means controls said drive means to place said detent means into the release state prior to the start of rotation of said rotatable member by said motor.

5. Printing apparatus according to claim 1, wherein said drive means comprises a solenoid comprising a pin, and a lever for engaging and disengaging said detent means to place said detent means in the restraint state and in the release state, wherein said pin is joined with said lever.

6. Printing apparatus according to claim 5, wherein said drive means further comprises a spring attached to said lever, for biasing said lever in one direction into engagement with said detent means, wherein displacement of said solenoid in response to an energization signal rotates said lever against the bias of said spring in the opposite direction out of engagement with said detent means.

7. Printing apparatus according to claim 6, wherein said lever comprises means for being rotated by said spring in one direction in response to terminating said energization signal to said solenoid.

8. Printing apparatus comprising:

a rotatable member for feeding a printing medium;

a detent gear of a predetermined gear pitch mounted for rotation with said rotatable member;

lever means mounted for engaging said detent gear to specify rotation positions of said rotatable member;

means for locking and releasing the engagement of said lever means to and from said detent gear;

a stepping motor, which rotates step by step in response to a rotation signal, for rotating said rotatable member, a rotary step of said rotatable member caused by one rotary step of said stepping motor being smaller than the predetermined gear pitch of said detent gear; and means for controlling said locking and releasing means to release the engagement of said lever means from said detent gear when the rotatable member is rotated by the stepping motor, and to engage the lever means with the detent gear to lock said rotatable member after said rotatable member is rotated by said stepping motor by an amount which corresponds to a multiple of the predetermined gear pitch of said detent gear and is then stopped, and for controlling said locking and releasing means to maintain said lever means released from said detent gear after said rotatable member is rotated by said stepping motor by an amount which does not correspond to a multiple of the predetermined gear pitch of said detent gear and is then stopped so that said lever means does not normally engage said detent gear, wherein said rotational position of said stepping motor is retained in response to a retention signal.

9. A printing apparatus according to claim 8, wherein said locking and releasing means comprises means for releasing the engagement of said detent gear and said lever means prior to the start of a rotation signal for said stepping motor.

10. A printing apparatus according to claim 8, wherein said stepping motor comprises means for initially receiving a determined voltage and means for then receiving a lower voltage.

11. The apparatus defined by claim 10, wherein said receiving means comprises means for initially receiving said determined voltage comprising a voltage of said rotation signal and means for then receiving said lower voltage comprising a voltage of said retention signal.

12. Printing apparatus according to claim 8, wherein the rotary step of said rotatable member caused by one rotary step of said stepping motor is a fraction of a minimum rotary step of said rotatable member provided by the predetermined gear pitch of said detent gear.

13. The apparatus defined by claim 8 wherein said locking and releasing means comprises a solenoid comprising a pin adapted to engage and disengage said lever means.

14. The apparatus defined by claim 13, wherein said locking and releasing means further comprises a spring attached to said lever means for biasing said lever means in one direction into engagement with said detent gear, wherein displacement of said solenoid in response to an energization signal rotates said lever means against the bias of said spring in the opposite direction out of engagement with said detent gear.

15. The apparatus defined by claim 14, wherein said lever means comprises means for being rotated by said spring in said one direction in response to terminating said energizing current to said solenoid.

* * * * *

UNITED STATES PATENT AND TRADEMARK OFFICE

CERTIFICATE OF CORRECTION

PATENT NO. : 4,971,466

DATED : November 20, 1990

INVENTOR(S) : Hiroatsu Kondo

It is certified that error appears in the above-identified patent and that said Letters Patent is hereby corrected as shown below:

COLUMN 2:

Line 48, close up right margin.

Line 49, close up left margin.

COLUMN 3:

Line 13, "determined period $t_1^x$" should read --determined period $t_1$--.

Signed and Sealed this

Sixteenth Day of June, 1992

*Attest:*

DOUGLAS B. COMER

*Attesting Officer*

*Acting Commissioner of Patents and Trademarks*